US010871305B2

(12) United States Patent
Bruhnke et al.

(10) Patent No.: US 10,871,305 B2
(45) **Date of Patent: *Dec. 22, 2020**

(54) DRY WALL EXTRUSION GRILLE

(71) Applicants: Lynne Bruhnke, Massapequa Park, NY (US); Daniel Roeper, Garden City, NY (US)

(72) Inventors: Lynne Bruhnke, Massapequa Park, NY (US); Daniel Roeper, Garden City, NY (US)

(73) Assignee: OEMETRIX, L.L.C., New Hyde Park, NY (US)

( * ) Notice: Subject to any disclaimer, the term of this patent is extended or adjusted under 35 U.S.C. 154(b) by 57 days.

This patent is subject to a terminal disclaimer.

(21) Appl. No.: 15/476,855

(22) Filed: Mar. 31, 2017

(65) Prior Publication Data

US 2017/0205110 A1 Jul. 20, 2017

Related U.S. Application Data

(63) Continuation-in-part of application No. 13/999,038, filed on Jan. 6, 2014, now Pat. No. 9,765,988.

(51) Int. Cl.
*F24F 13/08* (2006.01)
*F24F 7/00* (2006.01)

(52) U.S. Cl.
CPC ..... *F24F 13/084* (2013.01); *F24F 7/00* (2013.01); *F24F 13/082* (2013.01); *F24F 2007/003* (2013.01)

(58) Field of Classification Search
CPC ..... F24F 13/082; F24F 13/084; F24F 7/00
USPC ..... 454/330
See application file for complete search history.

(56) References Cited

U.S. PATENT DOCUMENTS 943,298 A * 12/1909 Brown ..... F24F 13/08 454/332
2,083,785 A * 6/1937 Harrison, Jr. ..... B60R 19/52 52/799.14
2,096,271 A * 10/1937 Young ..... F24F 13/075 454/309
2,245,908 A * 6/1941 Forrest ..... E06B 7/082 52/667
2,396,735 A * 3/1946 Leigh ..... F24F 13/08 52/799.14
2,464,442 A * 3/1949 De Roo ..... F24F 13/08 454/331
2,752,844 A * 7/1956 Simblest ..... F24F 13/08 454/277
2,956,496 A * 10/1960 Simblest ..... F24F 13/08 454/283
3,220,079 A * 11/1965 Aggson ..... E04B 1/7076 52/302.3
3,645,195 A * 2/1972 Koval ..... F24F 13/08 454/277
5,082,083 A 1/1992 Draffen
(Continued)

OTHER PUBLICATIONS

Definition of "Extended," Oxford English Dictionary, Oxford University Press, 2020 (Year: 2020).*

*Primary Examiner* — Edelmira Bosques
*Assistant Examiner* — Phillip Decker
(74) *Attorney, Agent, or Firm* — Philip M. Weiss; Weiss & Weiss

(57) ABSTRACT

A dry wall extrusion grille comprising a frame, a linear bar grille, indented slots, and a flexible mounting flange.

16 Claims, 8 Drawing Sheets

(56) References Cited

U.S. PATENT DOCUMENTS 5,144,099 A * 9/1992 Cardy ..... E04F 19/08 174/66
5,274,976 A * 1/1994 Burkhart ..... E06B 3/685 52/314
5,338,255 A * 8/1994 Akehurst ..... F24F 13/06 248/27.1
5,494,244 A * 2/1996 Walton ..... F24F 13/06 137/360
5,863,310 A * 1/1999 Brown ..... B01D 46/0005 454/284
5,928,078 A * 7/1999 Moore ..... F24F 13/068 285/341
5,950,384 A * 9/1999 Aarness ..... F24F 13/075 454/277
6,227,962 B1 * 5/2001 Orendorff ..... F24F 13/082 454/289
6,234,893 B1 * 5/2001 Meredith ..... F24F 13/085 454/289
6,234,894 B1 * 5/2001 Goracke ..... F24F 13/082 454/290
6,705,052 B1 * 3/2004 Larson ..... E04D 13/178 52/302.1
6,908,115 B2 * 6/2005 Synder ..... F24F 13/084 285/189
7,140,960 B2 * 11/2006 Pilger ..... F24F 13/06 454/331
7,232,369 B2 * 6/2007 Karidis ..... F24F 7/10 454/274
7,503,422 B2 * 3/2009 Combest ..... H04R 1/02 181/150
7,510,153 B2 * 3/2009 Hendricks ..... E04F 17/04 248/222.41
7,640,710 B1 * 1/2010 McAtee ..... F24F 13/084 454/277
7,771,259 B2 * 8/2010 Pettit ..... F24F 13/084 454/289
9,024,186 B1 * 5/2015 Gonzalez ..... H02G 3/14 174/66
2004/0058638 A1 * 3/2004 Achen ..... F24F 13/082 454/277
2007/0232217 A1 * 10/2007 Davis ..... F24F 13/082 454/330
2016/0273797 A1 * 9/2016 Bruhnke ..... F24F 13/084

* cited by examiner

DRY WALL EXTRUSION GRILLE

RELATED APPLICATIONS

The present application is a continuation in part of Ser. No. 13/999,038 filed Jan. 6, 2014.

FIELD OF THE INVENTION

The present invention relates to a dry wall extrusion grille comprising a frame, a linear bar grille, indented slots, and a flexible mounting flange.

BACKGROUND OF THE INVENTION

U.S. Pat. No. 5,082,083 relates to a structure wall mounted speaker assembly. The woofer of the speaker is mounted in the assembly wall frame and the tweeter is both mounted in and self-contained within the assembly wall frame. The installation requires only that a circular opening be cut in the wall to enable the rear portion of the woofer to extend through the dry wall or sheetrock and two simple holes drilled in the wall to accommodate the support bolts to retain the wall mounted speaker assembly on the wall.

U.S. Pat. No. 7,140,960 relates to duct systems, registers and ductwork components used with floor or ceiling registers employed in warm air heating, ventilating and air conditioning systems, and improvements for mounting and installing components of the duct system, including register boots, mud rings and register grilles, in the walls, floors or ceilings of buildings components, mud ring, register grille and wall, floor or ceiling opening, which reduces costs.

U.S. Pat. No. 7,771,259 relates to a flush mounted frame for an access panel or register. The frame is mounted to a wall, ceiling or floor surface, is made by joining linear frame sections each providing interconnected elements formed by an extrusion process. A first planar element is spaced apart from a second planar element and positioned for abutting a common surface. A first channel element is formed between the first and second planar elements. A third planar element is positioned normal to the first and second planar elements and terminates with a rib directed toward the first planar element. When mounted onto studs in a building structure, wall putty or mud may be placed into a space between the wall panels and the third planar element, the mud is captured in place forming a smooth interface between the frame assembly and the surrounding wall surfaces.

SUMMARY OF THE INVENTION

The present invention relates to a dry wall extrusion grille.

The dry wall extrusion grille comprises a frame, a linear bar grille, indented slots, a flexible mounting flange.

It is an object of the present invention for the indented slots to capture joint compound or plaster.

It is an object of the present invention for the flexible mounting flange to be used for fastening to a wall or ceiling with pre-perforated through holes.

It is an object of the present invention for the dry wall extrusion grille to further comprise sheet rock screws.

It is an object of the present invention for a common sheet rock screw to be threaded into the wall material.

It is an object of the present invention for the frame to be constructed of four mitered pieces. It is an object of the present invention for the four mitered pieces to be welded together. It is an object of the present invention for the mitered corners of the flexible mounting flange to be spot welded for additional strength.

It is an object of the present invention for the frame to be installed with a sheet rock screw before plaster or a joint compound is applied.

It Is an object of the present invention for the dry wall extrusion grille to be installed to a wall with four sheet rock screws.

It is an object of the present invention for the extrusion grille to have pre-perforated mounting through holes providing many mounting options to address multiple field conditions.

It is an object of the present invention for the extrusion grille to be a fully welded construction that provides exceptional strength for mounting in both walls and ceilings It is an object of the present invention for the extrusion grille to have multiple, pre-punched mounting holes for fastening in a wide range of wall conditions and materials.

It is an object of the present invention for the extrusion grille to have multiple, pre-punched mounting holes for attachment to underlying studs (support beams) for a wide range of center to centers.

It is an object of the present invention for the extrusion grille to have pre-punched holes accurately sized for standard wall board/sheet rock screws so no special hardware or tools are required.

It is an object of the present invention for the extrusion grille to have multiple indented slots along the mounting flange having a flexible edge to provide capture points for joint compound or plaster.

It is an object of the present for the extrusion grille's flexible mounting flange or edge to fasten the grille to uneven wall surfaces.

It is an object of the present invention for the inside of the extrusion grille frame to extend ¾" deep into the opening so that the extrusion grille is installed in a wall board or plaster ranging from about ¼" thru about ¾" thick.

It is an object of the present invention for the extrusion grille to allow an installer to cut a very rough hole in a wall and slip the extrusion grille frame into the opening. With the design of the present invention there is no routing or recessed cut that is necessary. With the design of the present invention there is no blocking or added wood necessary for attachment to wall.

It is an object of the present invention for the extrusion grille to provide exceptional strength using aluminum material—thus enabling safe use in ceiling applications.

It is an object of the present invention for the extrusion grille to be used with a fixed core (core welded directly to the frame or removable core for access to either controls, dampers or filtration behind the grille).

It is an object of the present invention for the extrusion grille to be used specifically for linear bar grilles, and not used with perforated grilles or registers.

It is an object of the present invention for the extrusion grille to be mounted, so that the entire frame and grille are flush to the wall providing a seamless installation—which makes field painting much easier—also makes future cleaning of the grille simpler as can be done with simply the wipe of a rag.

It is an object of the present invention for the extrusion grille to be mounted in only one way, so that it cannot be installed backward.

It is an object of the present invention for the extrusion grille to require four pieces for construction, providing faster assembly and lower cost.

It is an object of the present invention for the extrusion grille to have a special angled edge that provides a step for a standard spackle knife to rest when a plaster or joint compound is being applied. This creates a crisp, clean line set up for the application of the final skim coat of plaster (joint compound).

It is an object of the present invention for the drywall extrusion grille frame to be extended. The average height of the frame is approximately ¾". It is an object of the present invention for the frame to be extended at least ¾". It is an object of the present invention for the extended frame to have attached to it dampers or filter clips.

It is an object of the present invention for the dry wall extrusion grille to include mounting strips attached to the bottom of the frame. It is an object of the present invention for the mounting strips to be attached to the frame via welding. It is an object of the present invention for the mounting strips to be made as an integral part of the frame in a one piece extrusion.

It is an object of the present invention to provide multiple methods of attaching the linear bar grille to the frame with an attachment device. It is an object of the present invention for the attachment device to include mechanical fasteners, threaded inserts in the mounting strip to be used with mechanical fasteners, or a projection on the frame or mounting strip for use with spring steel clips.

It is an object of the present invention for the dry wall extrusion grille to have various style and depth angled edges to capture plaster or joint compound.

DETAILED DESCRIPTION OF THE INVENTION

Figure 1:
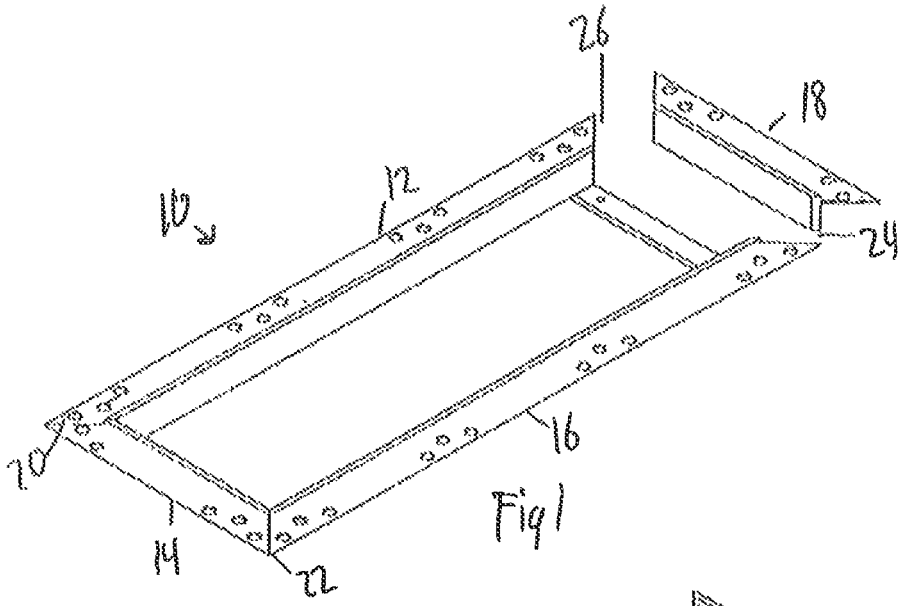
FIG. 1 is a top view of the frame of the present invention.
Figure 2:
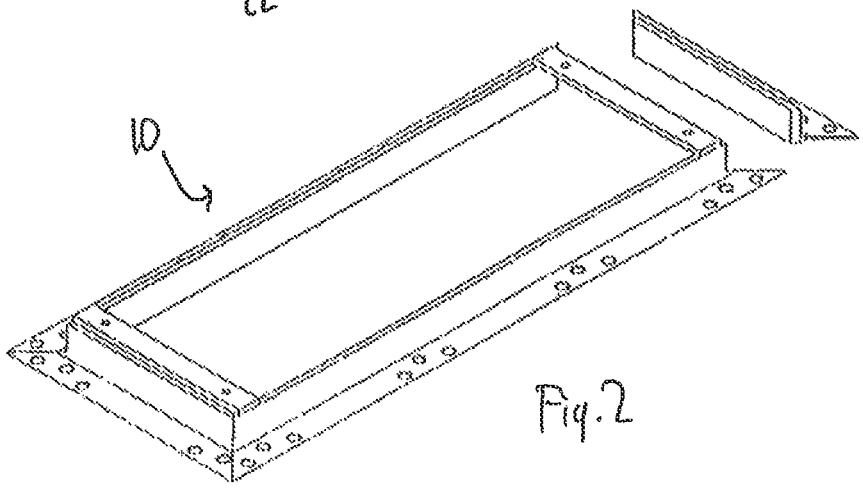
FIG. 2 is a bottom view of the frame of the present invention.

FIG. 1 shows the frame 10 comprising four mitered pieces 12, 14, 16 and 18, which are welded at 20, 22, 24, and 26. FIG. 2 shows the bottom view of frame 10 of FIG. 1.

Figures 3, 4:
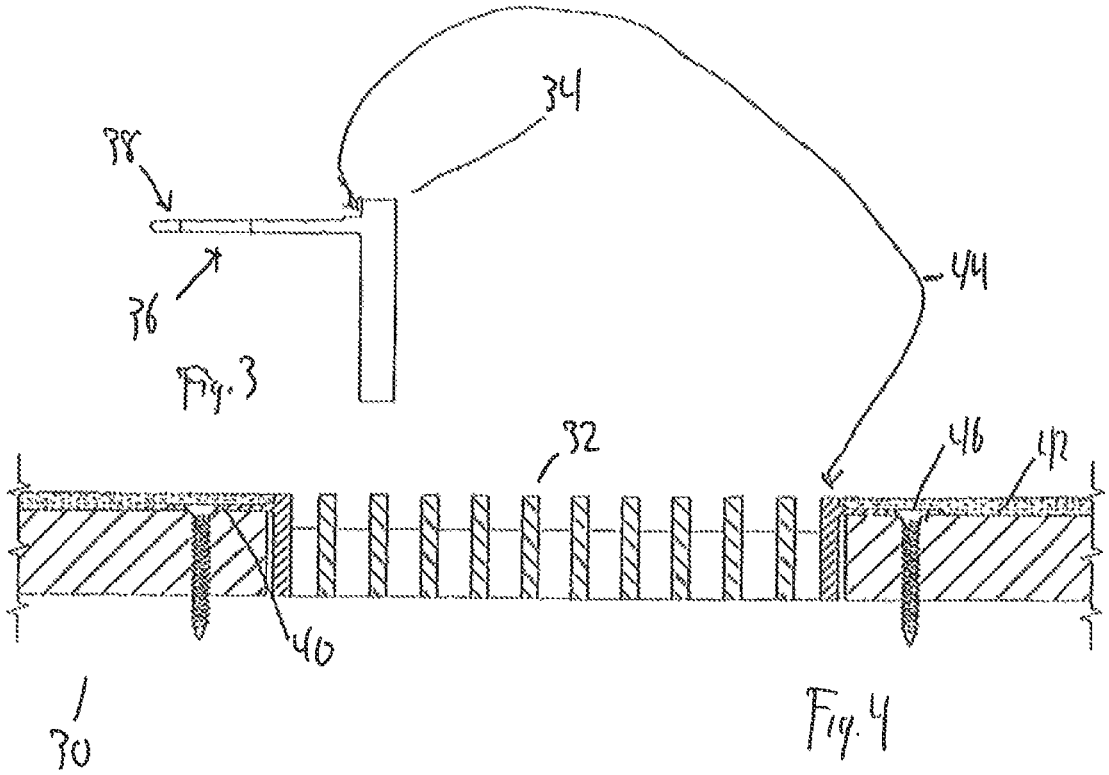
FIG. 3 is side view of the flexible edge of the present invention.
FIG. 4 is a cross sectional view of the extrusion grille of the present invention.

FIGS. 3 and 4 show the extrusion grille 30, which comprises a linear bar grille 32. The extrusion grille 30 has an aluminum profile 34, a flexible edge 36, that is used for fastening to a wall or ceiling with perforated through holes 40. The extrusion grille 30 further comprises indented slots 38 used to capture joint compound or plaster 42.

Extrusion grille 30 further comprises a special angled edge 44 to create a step for a spackling knife to use as a straight edge. A common sheet rock screw 46 is threaded into the wall material.

Figure 5:
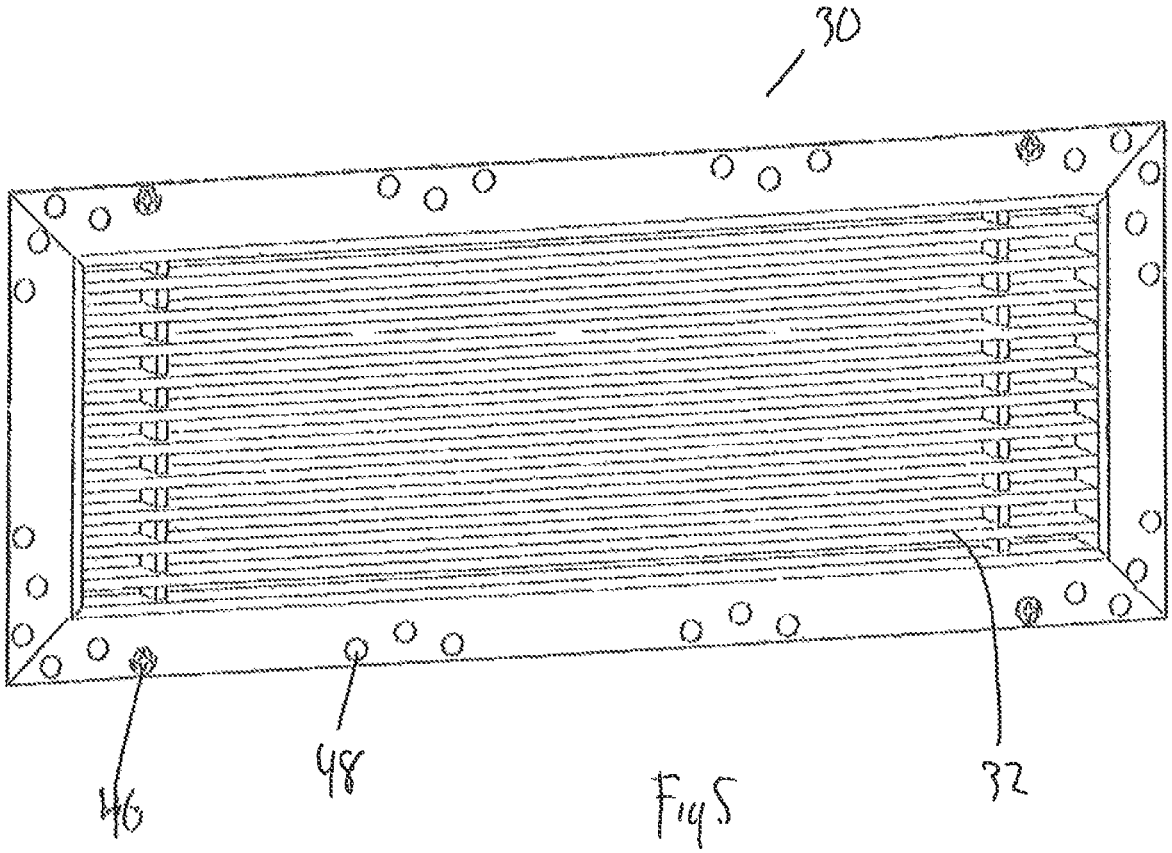
FIG. 5 is a front view of the extrusion grille of the present invention.

FIG. 5 shows the extrusion grille 30 having the linear bar grille, a standard sheet rock screw 46, and pre-perforated mounting through holes 48 that provide many mounting options to address multiple field conditions.

Figure 6:
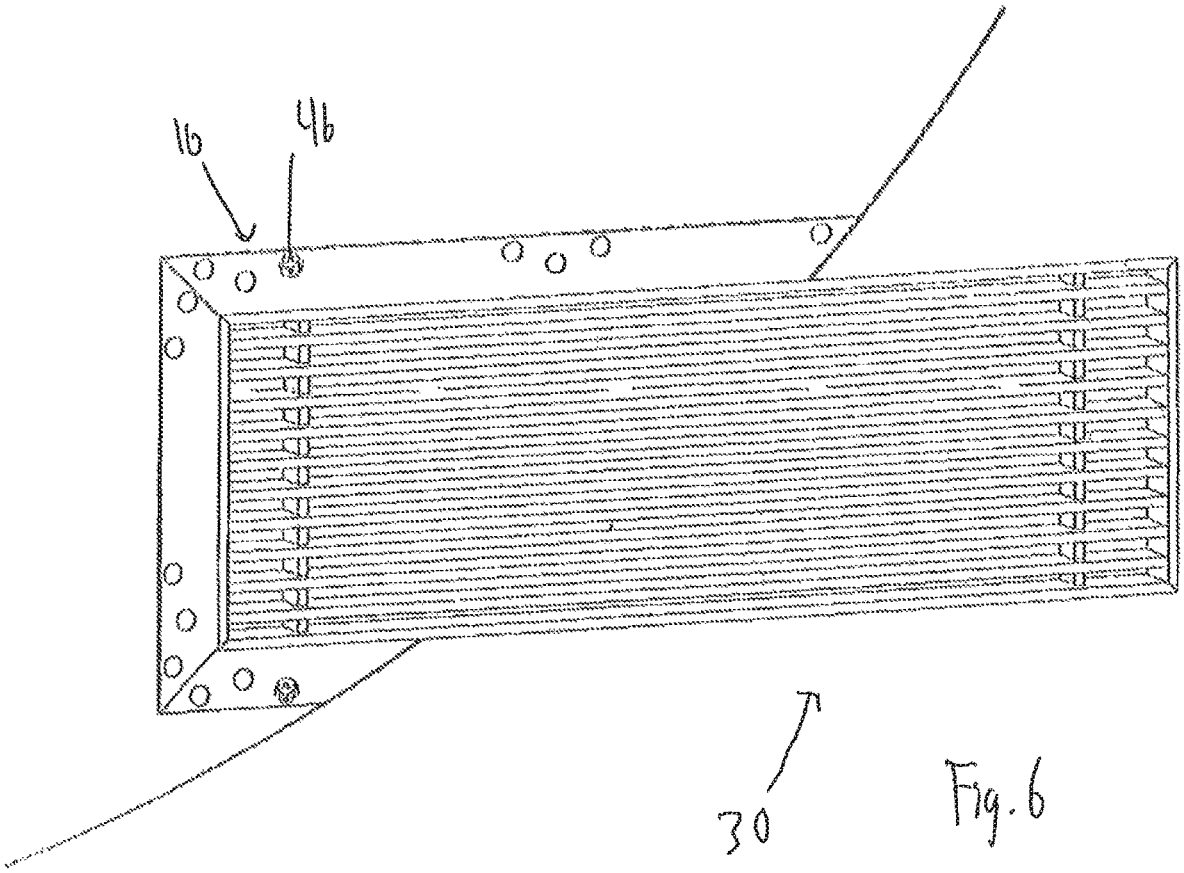
FIG. 6 is a front view of the extrusion grille of the present invention.

FIG. 6 shows the extrusion grille 30 installed after the plaster or joint compound is applied. The frame 10 is installed with the sheet rock screw 46 before plaster or joint compound is applied.

Figure 7:
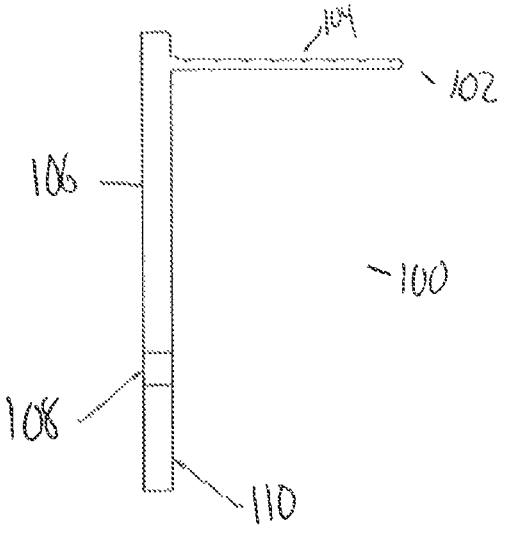
FIG. 7 is a side view of a flexible edge of the present invention.

FIG. 7 shows a dry wall extrusion grille 100 having a flexible edge 102. The flexible edge 102 has indented slots 104 used to capture joint compound or plaster. The frame 106 is extended by the length 110 to assist in attaching dampers or filters. The frame 106 further comprises a thru-hole 108. In a preferred embodiment, the extended length 110 is extended more than ¾" down.

Figure 8:
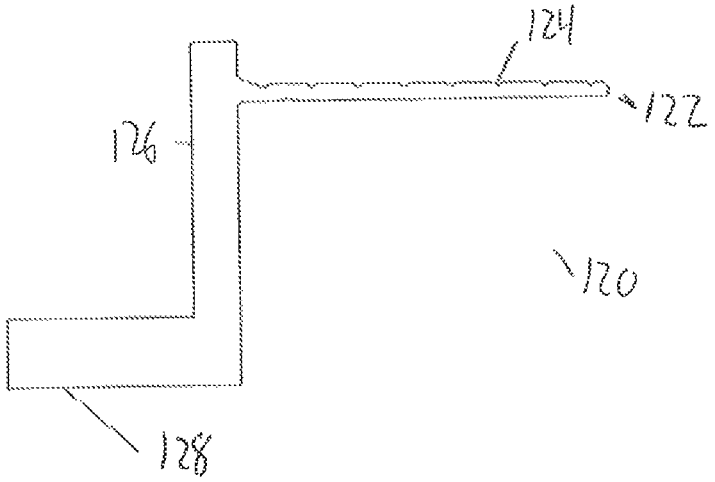
FIG. 8 is a side view of a flexible edge of the present invention.

FIG. 8 shows a dry wall extrusion grille 120 having a flexible edge 122. The flexible edge 122 has indented slots 124 used to capture joint compound or plaster. The frame 126 includes mounting strips 128 that are attached to the bottom of the frame 126 via welding or they can be made as an integral part of the frame 126 in a one piece extrusion.

Figure 9:
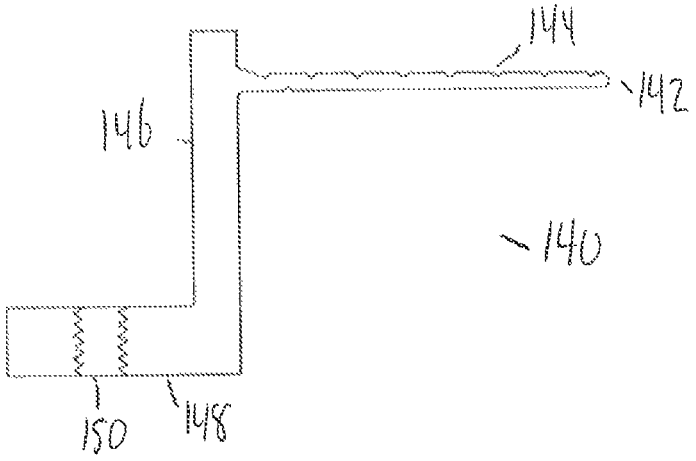
FIG. 9 is a side view of a flexible edge of the present invention.

FIG. 9 shows a dry wall extrusion grille 140 having a flexible edge 142. The flexible edge 142 has indented slots 144 used to capture joint compound or plaster. The frame 146 includes mounting strips 148 that are attached to the bottom of the frame 146. Multiple methods of attaching the linear bar grille to the frame 146 with an attachment device 150, that can include mechanical fasteners, threaded inserts in the mounting strip 148 to be used with mechanical fasteners, a projection on the frame 146 or mounting strip 148 for use with spring steel clips.

Figures 10, 10A:
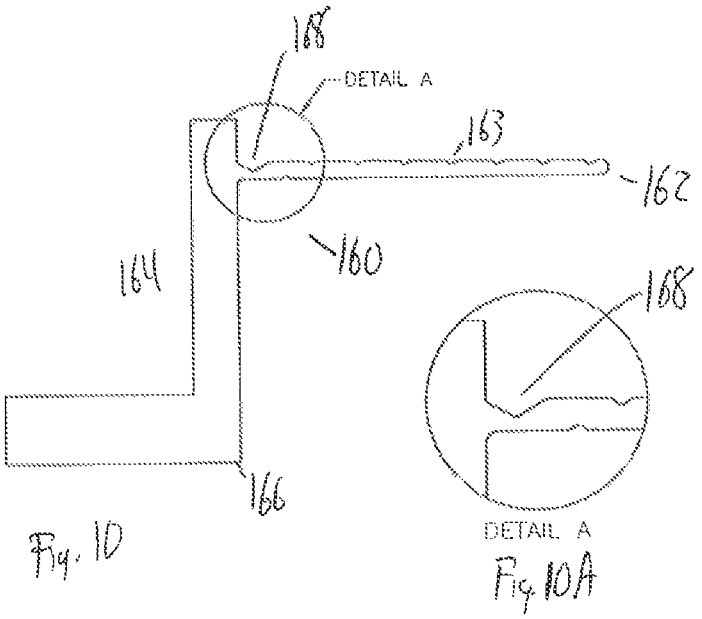
FIG. 10 is a side view of a flexible edge of the present invention.
FIG. 10A is an exploded view of a section of the flexible edge of FIG. 10.

FIG. 10 shows the dry wall extrusion grille 160 having a flexible edge 162. The flexible edge has indented slots 163 used to capture joint compound or plaster. The frame 164 includes mounting strips 166 that are attached to the bottom of the frame 164. The dry wall extrusion grille can have various style and depth angled edges 168 to capture plaster or joint compound.

FIG. 10A is an exploded view from a section of FIG. 10, showing the various style and angled edges 168 to capture plaster or joint compound.

The invention claimed is:

1. A dry wall extrusion grille comprising:

a frame;

a linear bar grille located in said frame comprised of vanes and cross members that direct a flow of air;

indented slots;

through holes;

a flexible mounting flange located between a top and bottom edge of the frame extending outwardly from said frame;

said indented slots defined as small recesses in said flexible mounting flange that receive plaster, joint compound or mud;

wherein said extrusion grille is used with a fixed core, a core welded directly to said frame, or a removable core.

2. The extrusion grille of claim 1 wherein said flexible mounting flange is fastened to a wall or ceiling with said through holes being pre-perforated.

3. The extrusion grille of claim 2 further comprising dry wall screws.

4. The extrusion grille of claim 3 wherein said frame is installed with said dry wall screws before plaster or a joint compound is applied.

5. The extrusion grille of claim 1 wherein said frame is constructed of mitered pieces.

6. The extrusion grille of claim 5 wherein said mitered pieces are welded together.

7. The extrusion grille of claim 1 wherein said extrusion grille is a fully welded construction.

8. The extrusion grille of claim 1 wherein an inside of said extrusion grille frame extends about ¾" deep into an opening so that said extrusion grille is installed in a wall board or plaster ranging from about ¼" thru about ¾" thick.

9. The extrusion grille of claim 1 wherein said extrusion grille is mounted, so that said entire frame and grille are flush to a wall providing a seamless installation.

10. A dry wall extrusion grille comprising:

a frame;

a linear bar grille located in said frame comprised of vanes and cross members that direct a flow of air;

through holes located in a flexible mounting flange;

indented slots;

said flexible mounting flange located between a top and bottom edge of the frame extending outwardly from said frame;

said indented slots defined as small recesses in said flexible mounting flange that receive plaster, joint compound or mud;

said frame being extended to at least ¾".

11. A dry wall extrusion grille comprising;

a frame;

a linear bar grille located in said frame comprised of vanes and cross members that direct a flow of air;

through holes located in a flexible mounting flange;

indented slots;

said flexible mounting flange located between a top and bottom edge of the frame extending outwardly from said frame;

said indented slots defined as small recesses in said flexible mounting flange that receive plaster, joint compound or mud;

mounting strips attached to a bottom of said frame.

12. The extrusion grille of claim 11 wherein said mounting strips are attached to said frame via welding.

13. The extrusion grille of claim 11 wherein said mounting strips are made as an integral part of said frame in one piece extrusion.

14. The extrusion grille of claim 11 further comprising an attachment device for attaching said linear bar grille to said frame.

15. The extrusion grille of claim 14 wherein said attachment device includes mechanical fasteners, threaded inserts in said mounting strips to be used with mechanical fasteners, or a projection on the frame or said mounting strips for use with spring steel clips.

16. The extrusion grille of claim 11 further comprising angled edges to capture plaster or joint compound.

* * * * *